US009262918B2

(12) United States Patent
Otake

(10) Patent No.: US 9,262,918 B2
(45) Date of Patent: Feb. 16, 2016

(54) VEHICLE-USE SIGNAL INFORMATION PROCESSING DEVICE AND VEHICLE-USE SIGNAL INFORMATION PROCESSING METHOD, AS WELL AS DRIVING ASSISTANCE DEVICE AND DRIVING ASSISTANCE METHOD

(75) Inventor: Hirotada Otake, Susono (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 94 days.

(21) Appl. No.: 14/113,501

(22) PCT Filed: May 13, 2011

(86) PCT No.: PCT/JP2011/061092

§ 371 (c)(1),
(2), (4) Date: Oct. 23, 2013

(87) PCT Pub. No.: WO2012/157048

PCT Pub. Date: Nov. 22, 2012

(65) Prior Publication Data

US 2014/0046509 A1 Feb. 13, 2014

(51) Int. Cl.
*G08G 1/095* (2006.01)
*G08G 1/0967* (2006.01)
(Continued)

(52) U.S. Cl.
CPC ..... *G08G 1/095* (2013.01); *G08G 1/09626* (2013.01); *G08G 1/096716* (2013.01);
(Continued)

(58) Field of Classification Search
CPC ..... G08G 1/096716; G08G 1/07; G08G 1/096783; G08G 1/081; G08G 1/095; G08G 1/096775; G08G 1/08; G08G 1/096758; G08G 1/16; G01C 21/34; G01C 21/3602; G01C 21/3629; G01C 21/3632; G01C 21/3641; G01C 21/3655; G01C 21/20; G01C 21/206; G01C 21/3469
USPC ..... 340/907, 905, 932, 988, 929, 911; 701/2, 23, 36, 400, 422, 454, 516
See application file for complete search history.

(56) References Cited

U.S. PATENT DOCUMENTS 6,012,012 A * 1/2000 Fleck et al. ..... 701/117
7,495,579 B2 * 2/2009 Sirota et al. ..... 340/907
(Continued)

FOREIGN PATENT DOCUMENTS

JP 2008 210066 9/2008
JP 2009 104333 5/2009
(Continued)

OTHER PUBLICATIONS

International Search Report Issued Aug. 23, 2011 in PCT/JP11/061092 Filed May 13, 2011.

*Primary Examiner* — Truc M Do
(74) *Attorney, Agent, or Firm* — Oblon, McClelland, Maier & Neustadt, L.L.P.

(57) ABSTRACT

A signal information processing device and a signal information processing method for calculating the state of a traffic light for driving assistance for traffic lights for which signal information is not transmitted from a roadside apparatus, and a driving assistance device and a driving assistance method for performing driving assistance on the basis of the calculated state of the traffic light. A driving assistance ECU of a vehicle acquires signal information corresponding to a first traffic light and information indicating the driving environment of the vehicle corresponding to a second traffic light placed at a position different from the first traffic light. The driving assistance ECU is provided with a signal information processing unit, which estimates signal information of the second traffic light by performing a computation on the basis of the signal information corresponding to the first traffic light and the information indicating the driving environment of the vehicle.

11 Claims, 4 Drawing Sheets

(51) Int. Cl.
*G08G 1/0962* (2006.01)
*G08G 1/082* (2006.01)

(52) U.S. Cl.
CPC .... *G08G1/096758* (2013.01); *G08G 1/096775* (2013.01); *G08G 1/096783* (2013.01); *G08G 1/082* (2013.01)

(56) References Cited

U.S. PATENT DOCUMENTS

| | | | | |
|---|---|---|---|---|
| 8,478,500 | B1 * | 7/2013 | Vahidi et al. | 701/93 |
| 8,520,695 | B1 * | 8/2013 | Rubin et al. | 370/445 |
| 8,981,964 | B2 * | 3/2015 | Matsumura | 340/907 |
| 9,111,453 | B1 * | 8/2015 | Alselimi | G06K 9/00785 |
| 2002/0059017 | A1 * | 5/2002 | Yamane et al. | 701/1 |
| 2005/0187701 | A1 * | 8/2005 | Baney | 701/117 |
| 2005/0273256 | A1 * | 12/2005 | Takahashi | 701/211 |
| 2006/0009188 | A1 * | 1/2006 | Kubota et al. | 455/344 |
| 2006/0055557 | A1 * | 3/2006 | Lu | 340/907 |
| 2007/0008173 | A1 * | 1/2007 | Schwartz | 340/902 |
| 2007/0053324 | A1 * | 3/2007 | Hwang | 370/335 |
| 2007/0222638 | A1 * | 9/2007 | Chen et al. | 340/901 |
| 2007/0222639 | A1 * | 9/2007 | Giles et al. | 340/907 |
| 2008/0088479 | A1 * | 4/2008 | Caminiti et al. | 340/932 |
| 2009/0112462 | A1 * | 4/2009 | Lo | 701/209 |
| 2010/0004839 | A1 * | 1/2010 | Yokoyama et al. | 701/70 |
| 2011/0068950 | A1 * | 3/2011 | Flaherty | 340/905 |
| 2011/0095906 | A1 * | 4/2011 | Stahlin | 340/905 |
| 2011/0115646 | A1 | 5/2011 | Matsumura | |
| 2011/0169661 | A1 * | 7/2011 | Eichhorst | G08G 1/087 340/906 |
| 2012/0143395 | A1 * | 6/2012 | Yamada et al. | 701/1 |
| 2013/0076538 | A1 * | 3/2013 | Uno et al. | 340/905 |
| 2013/0110315 | A1 * | 5/2013 | Ogawa | G08G 1/096716 701/1 |
| 2013/0190964 | A1 * | 7/2013 | Uehara | G01C 21/3691 701/25 |

FOREIGN PATENT DOCUMENTS

| | | |
|---|---|---|
| JP | 2009 176220 | 8/2009 |
| JP | 2009 265837 | 11/2009 |
| WO | 2010 103636 | 9/2010 |

* cited by examiner

90

| | | ROAD (VERTICAL) | | | |
|---|---|---|---|---|---|
| | | ROAD 1A (2 TRAFFIC LANES) | ROAD 2A (4 TRAFFIC LANES) | ROAD 3A (3 TRAFFIC LANES) | ROAD 4A (1 TRAFFIC LANE) |
| ROAD (HORIZONTAL) | ROAD 1S (2 TRAFFIC LANES) | INTERSECTION 70 2:2 | INTERSECTION 71 2:4 | INTERSECTION 72 2:3 | INTERSECTION 73 2:1 |
| | ROAD 2S (1 TRAFFIC LANE) | INTERSECTION 75 1:2 | INTERSECTION 76 1:4 | INTERSECTION 77 1:3 | INTERSECTION 78 1:1 |
| | ROAD 3S (3 TRAFFIC LANES) | INTERSECTION 80 3:2 | INTERSECTION 81 3:4 | INTERSECTION 82 3:3 | INTERSECTION 83 3:1 |

VEHICLE-USE SIGNAL INFORMATION PROCESSING DEVICE AND VEHICLE-USE SIGNAL INFORMATION PROCESSING METHOD, AS WELL AS DRIVING ASSISTANCE DEVICE AND DRIVING ASSISTANCE METHOD

FIELD OF THE DISCLOSURE

The present invention relates to a signal information processing device for a vehicle and a signal information processing method for a vehicle that calculate a state of a traffic light to assist the driving of a vehicle and a driving assistance device and a driving assistance method that assist the driving of a vehicle based on a calculated state of a traffic light.

BACKGROUND OF THE DISCLOSURE

Driving assistance devices are known that notify the driver of a vehicle of information on the driving environment of the vehicle, in particular, the state of a traffic light, thereby assisting the driving operation of the vehicle by the driver. Such driving assistance devices provide to the driver, based on signal information on a signal state of a traffic light and a signal cycle, obtained through an optical beacon, driving assists, such as a deceleration assist to decelerate the vehicle, and a run stopping assist to run or stop the vehicle. Patent Document 1 discloses an example driving assistance device that provides driving assistances of the vehicle to the driver in relation to a traffic light based on such signal information.

That is, the driving assistance device disclosed in Patent Document 1 assists the run stopping of the vehicle based on signal cycle information included in signal information obtained from an optical beacon. This driving assistance device includes uncertain cycle information specifying means for specifying uncertain cycle information indicating signal cycle information having an uncertain time that the traffic light changes from a red signal (stop light) to a green signal (forward movement permitting light), and assistance suppressing means for suppressing the run stopping assist for the vehicle to the uncertain cycle information specified by the uncertain cycle information specifying means. Hence, according to the driving assistance device of Patent Document 1, a vehicle driving assist in relation to a traffic light is performed based on signal cycle information, but the execution of the driving assist is suppressed in relation to a traffic light having uncertain signal cycle information.

PRIOR ART DOCUMENT

Patent Document

Patent Document 1: Japanese Laid-Open Patent Publication No. 2009-265837

SUMMARY OF THE INVENTION

Problems that the Invention is to Solve

In consideration of trouble and costs to install roadside devices (infrastructure devices) like optical beacons that transmit signal information on a traffic light to each traffic light, it is difficult to install corresponding roadside devices to all traffic lights on the roads. Thus, in practice, the traffic lights that are capable of transmitting signal information are limited, and other traffic lights are unable to transmit local signal information. In this case, the driving assistance device of Patent Document 1 is unable to calculate the state of a traffic signal that cannot transmit signal information, and thus even a driving assist is inapplicable in relation to such traffic lights.

Accordingly, it is an object of the present invention to provide a signal information processing device for a vehicle and a signal information processing method for a vehicle that can calculate a state of a traffic light for a driving assist, in relation to a traffic light that does not transmit signal information. Moreover, it is another object of the present invention to provide a driving assistance device and a driving assistance method that perform a driving assist on a vehicle based on the calculated state of the traffic light.

Means for Solving the Problems

Means for achieving the above objective and advantages thereof will now be discussed.

To achieve the foregoing objective, the present invention provides a signal information processing device for a vehicle that processes signal information containing information on a state of a traffic light. The signal information processing device includes a signal information estimating section, which obtains signal information corresponding to a first traffic light, also obtains information on a driving environment for a vehicle corresponding to a second traffic light that is installed at a different location from the first traffic light, and estimates signal information on the second traffic light through a calculation based on the signal information corresponding to the first traffic light and the obtained information on the driving environment for the vehicle.

To achieve the foregoing objective, the present invention also provides a signal information processing method for a vehicle for processing signal information containing information on a state of a traffic light. The method includes: obtaining signal information corresponding to the first traffic light and obtaining information on a driving environment of a vehicle corresponding to a second traffic light installed at a different location from the first traffic light; and estimating signal information on the second traffic light through a calculation based on the signal information corresponding to the first traffic light and the obtained information on the driving environment of the vehicle.

According to such a configuration or a method, a calculation is performed based on the obtained signal information on the first traffic light and the obtained information on the driving environment at the second traffic light. This enables estimation of the signal information on the second traffic light. Hence, the signal information processing device is capable of obtaining signal information on a traffic light that does not transmit the signal information, enabling a driving assist for the vehicle in relation to a traffic light of which signal information is unobtainable.

The signal information processing device is capable of obtaining signal information necessary for a driving assist even if the signal information is not transmitted from a roadside device, and thus the amount of signal information output by the roadside device can be reduced.

In accordance with a preferable configuration, the second traffic light is installed at an intersection, and the signal information estimating section estimates the signal information on the second traffic light through a calculation based on the signal information corresponding to the first traffic light and information on a driving environment at the intersection.

In accordance with a preferable method, the second traffic light is installed at an intersection, and the estimating of the signal information is executed by estimating signal information on the second traffic light through a calculation based on the signal information corresponding to the first traffic light and information on a driving environment at the intersection.

The operation of the traffic light provided at an intersection is often adjusted in accordance with the respective driving environments of multiple roads intersecting with each other at the intersection. Hence, according to such a configuration or a method, the signal information processing device is capable of estimating the signal information on the second traffic light provided at the intersection through a calculation based on the information on the driving environment at the intersection and the signal information corresponding to the first traffic light. This enables an appropriate driving assist, for the vehicle in relation to the traffic light at the second intersection, which is an estimation target.

In accordance with a preferable configuration, the information on the driving environment is information on the number of traffic lanes of each of a plurality of roads intersecting with each other at the intersection.

In accordance with a preferable method, the information on the driving environment is information on the number of traffic lanes of each of a plurality of roads intersecting with each other at the intersection.

The number of vehicles passing through the intersection often increases or decreases in accordance with the number of traffic lanes of a cross-road. Hence, according to such a configuration or a method, the signal information processing device is capable of estimating the signal information on the second traffic light through, for example, a comparison of the number of traffic lanes based on the number of traffic lanes of each road intersecting at the intersection. This enables an appropriate driving assist, for the vehicle in relation to a traffic light at the second intersection, which is an estimation target.

In accordance with a preferable configuration, the information on the driving environment is information on the traffic amount of each of a plurality of roads intersecting with each other at the intersection.

The intersection often has a time length for permitting a traffic so as not to increase the number of vehicles waiting for a signal in each road intersecting at the intersection, i.e., in accordance with the traffic amount. Hence, according to such a configuration or a method, the signal information processing device is capable of estimating the signal information on the second traffic light provided at the intersection through, for example, a comparison of the traffic amount based on the traffic amount of each road intersecting at the intersection. This enables an appropriate driving assist, for the vehicle in relation to a traffic light at the second intersection, which is an estimation target.

In accordance with a preferable configuration, the signal information estimating section estimates, as the signal information on the second traffic light to be estimated, an instruction period at which the second traffic light instructs the vehicle to move forward or to stop.

In accordance with a preferable method, in the step for estimating the signal information, as the signal information on the second traffic light to be estimated, an instruction period at which the second traffic light instructs the vehicle to move forward or to stop is estimated.

According to such a configuration or a method, the signal information processing device for a vehicle is capable of estimating the instruction period at which the second traffic light instructs the vehicle to move forward or to stop, i.e., the signal split time of the second traffic light based on information on the driving environment at the second traffic light. This enables an appropriate estimation of the signal split time of the second traffic light in accordance with the driving environment, i.e., a signal split time that is highly likely to be set for the second traffic light under such a driving environment.

In accordance with a preferable configuration, the signal information on the first traffic light further contains a starting time point at which the first traffic light starts permitting the vehicle to move forward. The signal information estimating section further obtains information on a time difference between the forward movement permission starting time point by the first traffic light and a forward movement permission starting time point by the second traffic light, and further estimates, as the signal information on the second traffic light, an ending time point at which the forward movement permission by the second traffic light ends based on the estimated instruction period, the starting time point of the first traffic light, and the obtained information on the time difference.

According to such a configuration, the signal information processing device is capable of obtaining the ending time point together with the starting time point of the forward movement permission instruction (i.e., green signal) of the second traffic light. The ending time point of the permission instruction corresponds to the starting time point of the stop instruction (i.e., red signal or yellow signal) of the second traffic light, and thus a run stopping assist or the like that is a driving assist performed based on the starting time point of the stop instruction is enabled. Accordingly, the applicable fields of the signal information processing device in a driving assistance device are expanded.

In accordance with a preferable configuration, the signal information estimating section estimates the signal information on the second traffic light based on a presumption that a time interval at which the first traffic light repeatedly starts permitting a traffic to move forward is equal to a time interval at which the second traffic light repeatedly starts permitting a traffic to move forward.

In general, multiple traffic lights having the starting time point of the green signal cooperatively controlled are subjected to an effective cooperative control through a synchronization of, for example, the period of the green signal, i.e., the signal cycle. Hence, the time interval for a forward movement permission in the signal information on the second traffic light is highly probably equal to the time interval for repeating the forward movement permission in the signal information on the first traffic light. Hence, according to such a configuration, the signal information processing device utilizes the time interval for repeating the forward movement permission in the signal information on the first traffic light as a time interval at which the second traffic light repeats the forward movement permission to appropriately estimate the signal information on the second traffic light.

In accordance with a preferable configuration, the signal information estimating section estimates, as the signal information on the second traffic light to be estimated, a time interval between a plurality of forward movement permission starts repeatedly provided to a traffic.

According to such a configuration, the signal information processing device estimates a time interval between the respective starts of the forward movement permissions by the second traffic light, thereby obtaining the lag of the cycle of the second traffic light in relation to the first traffic light. This enables an appropriate driving assist, for the vehicle in relation to the second traffic light.

In accordance with a preferable configuration, the signal information estimating section obtains the signal information corresponding to the first traffic light and the information on the driving environment corresponding to the second traffic light from a roadside device that is provided at a roadside to correspond to the first traffic light.

According to such a configuration, when the vehicle passes through the nearby location of the first traffic light, the signal information estimating section is capable of obtaining the signal information corresponding to the first traffic light and to also obtain information on the driving environment corresponding to the second traffic light at the same time. This enables the signal information processing device to appropriately estimate the signal information on the second traffic light together with an obtainment of the signal information on the first traffic light.

In accordance with a preferable configuration, the signal information estimating section is built in the vehicle.

According to such a configuration, the use of the estimated signal information on the second traffic light is facilitated in the vehicle. Hence, the usefulness of the signal information on the second traffic light estimated in this manner is enhanced when, for example, the driving assistance device utilizes such information for a driving assist for the vehicle.

To achieve the foregoing objective, the present invention provides a driving assistance device including a signal information processing device for a vehicle that processes signal information containing information on a state of a traffic light. The driving assistance device is configured to perform a driving assist for a vehicle based on information processed through the signal information processing device. The signal information processing device is any of the above described the signal information processing devices. The driving assistance device performs the driving assist for the vehicle in relation to a second traffic light based on signal information on the second traffic light estimated by the signal information processing device.

To achieve the foregoing objective, the present invention provides a driving assistance method utilizing a signal information processing method for a vehicle for processing signal information containing information on a state of a traffic light. The driving assistance method includes performing a driving assist for a vehicle in relation to the traffic light based on a state of the traffic light. The signal information processing method is any of the above described the signal information processing methods, in which a driving assist for the vehicle in relation to the second traffic light is performed based on signal information on the second traffic light estimated through the signal information processing method.

According to such a configuration or a method, in relation to, for example, the second traffic light that the driving assistance device cannot directly obtain signal information thereon, the driving assistance device is capable of performing a driving assist for the vehicle like a run stopping assist or a passing assist in relation to the traffic light by utilizing the signal information on the second traffic light, which is estimated by the signal information processing device. This extends the target range of the driving assist for the vehicle by the driving assistance device to traffic lights that do not transmit signal information. This makes the driving assist for the vehicle more convenient.

DETAILED DESCRIPTION OF THE PREFERRED EMBODIMENTS

A description will be given of a driving assistance device built with a signal information processing device for a vehicle according to one embodiment of the present invention with reference to FIGS. 3 to 5. As a premise, with reference to FIG. 1, a running condition of a running road 20 that is a road on which a vehicle 10 subjected to driving assist by the driving assistance device runs will be described first.

Figure 1:
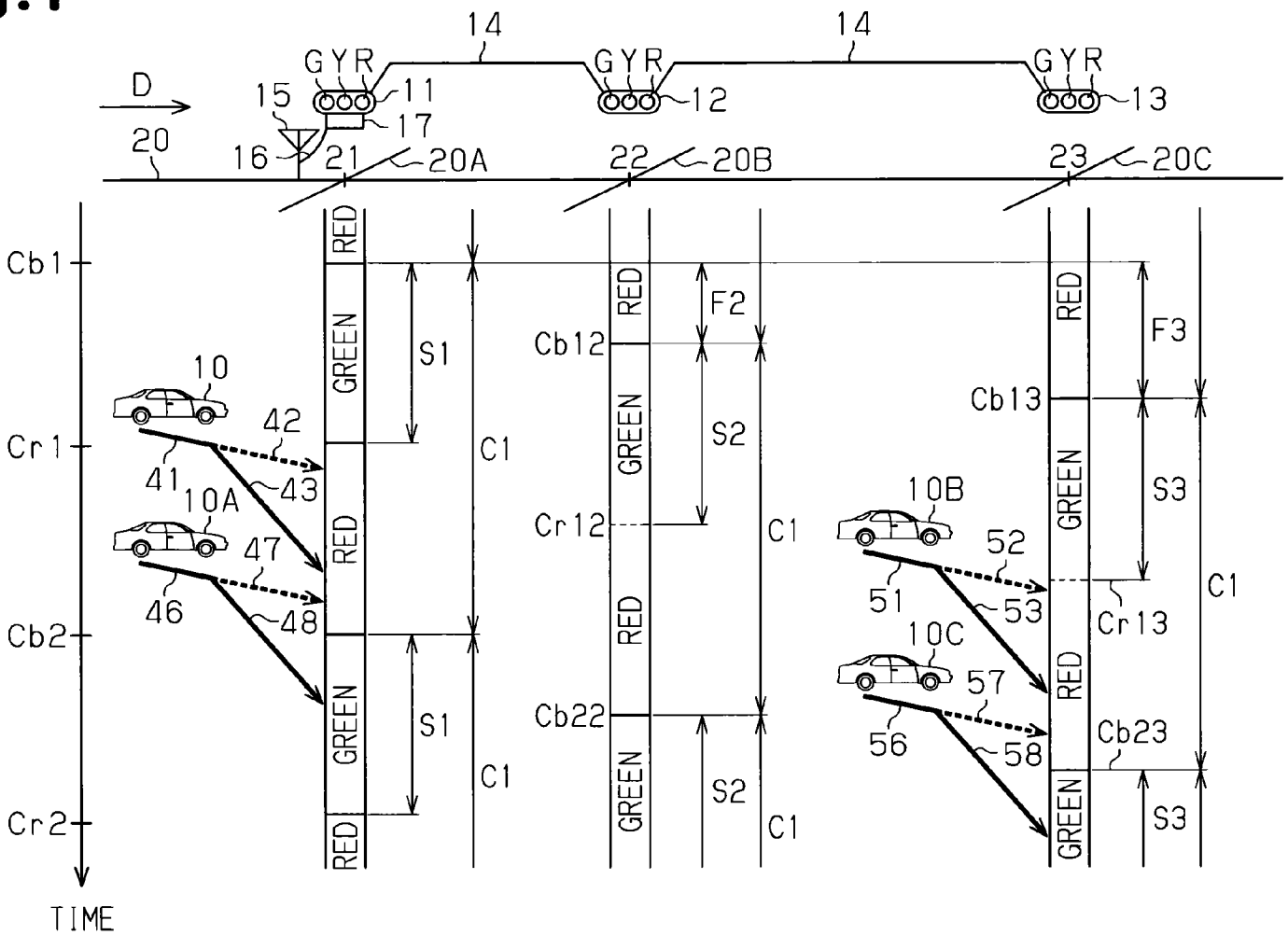
FIG. 1 is a time chart exemplarily illustrating a relationship between a traffic light on a road subjected to a driving assist by a driving assistance device including a signal information processing device for a vehicle of the present invention and an elapsed time of the traffic signal.

As illustrated in FIG. 1, the running road 20 has a traffic lane with a direction from the left to the right in FIG. 1, i.e., the direction of the arrow (D) as a travel direction D of the vehicle. Provided in the running road 20 are, from the near side in the travel direction D to the far side thereof, a first intersection 21, a second intersection 22, and a third intersection 23 in this order with respective intervals. A first traffic light 11 is provided at the first intersection 21, and a second traffic light 12 is provided at the second intersection 22. Moreover, a third traffic light 13 is provided at the third intersection 23. In this embodiment, illustration and description for other facilities than the first to third traffic lights 11 to 13 provided at the respective first to third intersections 21 to 23 are omitted for simplifying the description. That is, illustration and description for facilities to the traffic lane other than the travel direction D, i.e., a traffic light to a cross-road 20A (conceptually illustrated in FIG. 2), which is a road intersecting the running road 20, and a traffic light to a traffic lane opposite to the travel direction D of the running road 20 are omitted.

The first to third traffic lights 11 to 13 are each a traffic light for vehicles that provides an indication of an instruction to the vehicle 10 running in the travel direction D, such as a stop signal (yellow signal Y or a red signal R) and forward movement permitting light (green signal G). The first traffic light 11 is set with a signal cycle C1, which is the time interval between the starting time point of the prior green signal G and the starting time point of the next green signal G, and a signal split time S1, which is a period for continuously indicating and displaying the green signal G, i.e., a forward movement permitting light within a signal cycle C1. More specifically, the signal cycle C1 is a time interval between the starting time points of repeated green signals G, and is, a time interval between the starting time point (green starting time point Cb1) of the prior green signal and the starting time point (green starting time point Cb1) of the next green signal G. The signal split time S1 is a time from the green starting time point Cb1 to the ending time point of the green signal G. When the starting time point of a stop light (red signal R or yellow signal Y) is a "red starting time point Cr1", the signal split time S1 is a time "Cr1-Cb1" from the green starting time point Cb1 to the red starting time point Cr1. In order to simplify the description, in the following description, the red signal R and the yellow signal Y are collectively defined as a "red signal" in many cases. That is, the starting time point of the stop light is collectively defined as a "red starting time point Cr1". In the case of, for example, two-color traffic light with red and green colors, the "red starting time point Cr1" indicates the starting time point of the red signal R literally, but in the case of three-color traffic light with red, green, and yellow colors, the "red starting time point Cr1" indicates the starting time point of the yellow signal Y in most cases.

In the first traffic light 11, the red starting time point Cr1, and a red period, which is the period for indicating and displaying the stop light (e.g., C1-S1) can be calculated based on the set signal cycle C1 and signal split time S1. That is, when the signal cycle C1 starts, the first traffic light 11 indicates and displays the green signal G during the signal split time S1, and indicates and displays the red signal R or the yellow signal Y during the following red period. The first traffic light 11 repeats the indication and displaying of the green signal G and the red signal R, at a time interval of the signal cycle C1. The green starting time point Cb1 is information that changes (increases by a signal cycle C1) every time the first traffic light 11 repeats the indication and displaying of the green signal G, and the signal split time S1 and the signal cycle C1 are information changeable as needed.

Likewise, the second traffic light 12 is set with the signal cycle C1 and a signal split time S2. Hence, when the signal cycle C1 starts, the second traffic light 12 indicates and displays the green signal G during the signal split time S2, and then indicates and displays the red signal R or the yellow signal Y during the red period obtained by "signal cycle C1"-"signal split time S2". The second traffic light 12 repeats the indication and displaying of the green signal G and the red signal R, at a time interval of the signal cycle C1.

Likewise, the third traffic light 13 is set with the signal cycle C1 and a signal split time S3. Hence, when the signal cycle C1 starts, the third traffic light 13 indicates and displays the green signal G during the signal split time S3, and then indicates and displays the red signal R or the yellow signal Y during the period obtained by "signal cycle C1"-"signal split time S3". Next, the third traffic light 13 repeats the indication and displaying of the green signal G and the red signal R, at a time interval of the signal cycle C1. As described above, in this embodiment, the description will be given of a case in which the signal cycle C1 is common to the first to third traffic lights 11 to 13 for simplifying the description.

The first to third traffic lights 11 to 13 are connected with each other via communication lines 14 such that the second and third traffic lights 12 and 13 can receive a control signal from the first traffic light 11. Hence, the first to third traffic lights 11 to 13 form a traffic light group having operations like indication and displaying collectively managed. The first to third traffic lights in this traffic light group are collectively controlled by a collective control device 17 provided in the first traffic light 11. That is, operations like indication and displaying by the first to third traffic lights 11 to 13 are controlled based on control signals from the collective control device 17 in the first traffic light 11. The collective control device 17 sets the signal cycle C1, the signal split time S1, and the starting time point of the signal cycle C1, i.e., the green starting time point Cb1 to the first traffic light 11. Moreover, the collective control device 17 sets the signal cycle C1, the signal split time S2, and a green starting time point Cb12, which is a starting time point of the signal cycle C1 to the second traffic light 12. Furthermore, the collective control device 17 sets the signal cycle C1, the signal split time S3, and a green starting time point Cb13, which is a starting time point of the signal cycle C1 to the third traffic light 13.

The collective control device 17 controls the second and third traffic lights 12 and 13 to follow the first traffic light 11. That is, the collective control device 17 sets, for an operation of the second traffic light 12 relative to an operation of the first traffic light 11, a signal lag F2, which is a time difference based on a difference in distance from the first traffic light 11, thereby delaying the green starting time point Cb12 of the second traffic light 12 from the green starting time point Cb1 of the first traffic light 11 by the signal lag F2. Likewise, the collective control device 17 sets, for an operation of the third traffic light 13 relative to an operation of the first traffic light 11, a signal lag F3, which is a time difference defined based on the distance between the first traffic light 11 and the third traffic light 13, thereby delaying the green starting time point Cb13 of the third traffic light 13 from the green starting time point Cb1 of the first traffic light 11 by the signal lag F3. More specifically, the signal lag F2 of the second traffic light 12 is, for example, calculated based on a distance from the first traffic light 11 to the second traffic light 12 and an average vehicle speed in the running road 20. The signal lag F3 of the third traffic light 13 is calculated based on a distance from the first traffic light 11 to the third traffic light 13 and an average vehicle speed in the running road 20.

That is, the traffic light group including the first to third traffic lights 11 to 13 is collectively controlled with reference to the green starting time point Cb1 of the first traffic light 11. That is, the signal cycle C1 of the second traffic light 12 starts from a time elapsed from the green starting time point Cb1 of the first traffic light 11 by the signal lag F2, and the signal cycle C1 of the third traffic light 13 starts from a time elapsed from the green starting time point Cb1 of the first traffic light 11 by the signal lag F3.

Figure 2:
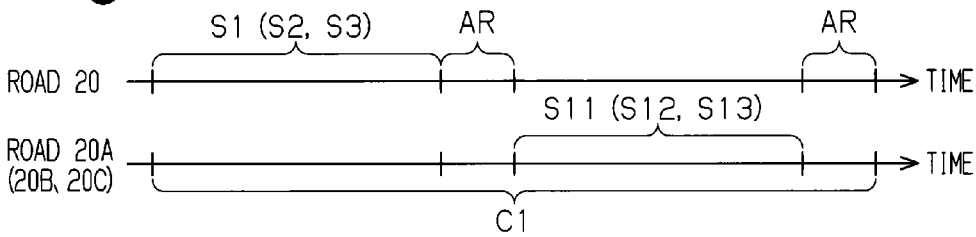
FIG. 2 is a time chart exemplarily illustrating a division of signal split times in a cross-road at an intersection illustrated in FIG. 1 in a manner separated into a running road and the cross-road.

The respective signal split times S1 to S3 of the first to third traffic lights 11 to 13 are calculated by the collective control device 17 in accordance with a driving environment, i.e., respective road shapes of the corresponding first to third intersections 21 to 23. For example, as illustrated in FIG. 2, in the first intersection 21, the signal split time S1 is divided to the running road 20. Divided to a cross-road 20A intersecting the running road 20 by the collective control device 17 is an intersection signal split time S11, which is a signal split time for continuously indicating and displaying the green signal G of the traffic light at the first intersection 21 in the cross-road. The intersection signal split time S11 is set by the collective control device 17 so as not to overlap at least the signal split time S1 on the same time axis thereof, to be within the signal cycle C1 common to the signal split time S1, and to be a time having all red time AR excluded. The term "all red time AR" means a time at which the traffic light to the running road 20 at the first intersection 21 and the traffic light to the cross-road 20A are both the red signal. In this case, it is presumed that within a signal cycle C1, all red time AR appears twice at the end of the signal split time S1 and at the end of the intersection signal split time S11 (S1+S11+2AR=C1). That is, the signal cycle C1 is longer than the sum of the signal split time S1 and the intersection signal split time S11 (S1+S11<C1). Hence, the total signal split time dividable to the running road 20 and the cross-road 20A from the time obtained by subtracting two all read times AR from the signal cycle C1 is "S1+S11".

In this embodiment, the total signal split time (S1+S11) is divided by the collective control device 17 to the running road 20 and the cross-road 20A such that in the first intersection 21, the number of vehicles waiting for a signal in the running road 20 and the number of vehicles waiting for a signal in the cross-road 20A become as minimum as possible. In relation to the first traffic light 11, the collective control device 17 sets the allocation of the total signal split time (S1+S11) to the respective roads 20 and 20A in accordance with a driving environment. Hence, the collective control device 17 divides more signal split time to a road with a larger traffic, and divides more signal split time to a road with a larger number of traffic lanes. Accordingly, the respective signal split times S1 and S11 at the first intersection 21 become the same value or different values in accordance with the driving environment.

The collective control device 17 sets, for the second traffic light 12, the signal split time S2 to the running road 20 and an intersection signal split time S12 to a cross-road 20B that is a road intersecting the running road 20 in accordance with the driving environment at the second intersection 22 like the setting of the respective signal split times S1 and S11 of the first traffic light 11.

Furthermore, the collective control device 17 sets, for the third traffic light 13, the signal split time S2 to the running road 20 and an intersection signal split time S13 to a cross-road 20C that is a road intersecting the running road 20 in accordance with the driving environment at the third intersection 23 like the setting of the respective signal split times S1 and S11 of the first traffic light 11.

As described above, the individual signal split times S1 and S11 of the first traffic light 11 are set by, for example, the collective control device 17 based on the driving environment at the second intersection 22. The individual signal split times S2 and S12 of the second traffic light 12 are set by the collective control device 17 based on the driving environment at the second intersection 22, and the individual signal split times S3 and S13 of the third traffic light 13 are set by the collective control device 17 based on the driving environment at the third intersection 23. It is not always true that the respective situations of the cross-roads 20A, 20B, and 20C relative to the running road 20 are the same, and thus the respective signal split times S1, S2, and S3 of the first to third traffic lights 11 to 13 relative to the running road 20 become the same value or become different values. Likewise, the respective intersection signal split times S11, S12, and S13 relative to the cross-roads 20A, 20B, and 20C that intersect the running road 20 at the first to third traffic lights 11 to 13, respectively, become the same value or become different values.

Thus, the driving assistance device utilizes, for example, the green starting time point Cb1 of the first traffic light 11 to calculate the green starting time point Cb12 of the second traffic light 12 based on the signal lag F2. Moreover, the driving assistance device utilizes the green starting time point Cb1 of the first traffic light 11 to calculate the green starting time point Cb13 of the third traffic light 13 based on the signal lag F3. Furthermore, the driving assistance device can calculate a next green starting time point Cb22 to the green starting time point Cb12 of the second traffic light 12, and a next green starting time point Cb23 to the green starting time point Cb13 of the third traffic light 13. However, the signal split times S1, S2, and S3 are set individually by the collective control device 17 based on, for example, the driving environment at the first to third traffic lights 11 to 13. Hence, when the respective signal split times S1, S2, and S3 are unknown, the driving assistance device is unable to calculate the red starting time points Cr1, Cr12, and Cr13 of the first to third traffic lights 11 to 13. The collective control device 17 possesses all necessary information for operation controls on the first to third traffic lights 11 to 13, i.e., the respective signal split times S1, S2, and S3, and thus the collective control device is capable of correctly calculating the respective red starting time points Cr1, Cr12, and Cr13, and of controlling the operations of the first to third traffic lights 11 to 13.

As illustrated in FIG. 1, in the running road 20, provided at the near side of the first intersection 21 in the travel direction D is a wireless beacon 15 like an optical beacon. The wireless beacon 15 is configured to transmit various information to vehicles through a wireless communication utilizing light like infrared light. More specifically, the wireless beacon 15 includes a transmitter provided above the road, and has a communicable area set below the transmitter. Hence, the wireless beacon 15 is capable of transmitting information to vehicles passing through this communicable area.

The wireless beacon 15 is connected with the first traffic light 11 in a manner communicable therewith through a communication line 16. The wireless beacon 15 obtains, from the collective control device 17 of the first traffic light 11, signal information on the first traffic light 11, the signal lag F2 of the second traffic light 12, and the signal lag F3 of the third traffic light 13. The wireless beacon 15 converts the obtained signal information on the first traffic light 11, and the respective signal lags F2 and F3 into wireless signals, and transmits such wireless signals. The signal information on the first traffic light 11 include "position information" indicating the position of the first traffic light 11, the green starting time point Cb1, the signal split time S1, and the signal cycle C1, etc. The "position information" has its content unchanged, and is set in the first traffic light 11 in advance.

As described above, the collective control device 17 of the first traffic light 11 possesses respective signal information on the second traffic light 12 and the third traffic light 13 similar to the signal information on the first traffic light 11, but does not provide all information on the second traffic light 12 and the third traffic light 13 to the wireless beacon 15. This is because the amount of data that the wireless beacon 15 can transmit to the vehicle 10, i.e., the communication capacity is limited, that is, it is necessary to, for example, reduce the amount of data transmitted from the wireless beacon 15. Hence, the wireless beacon 15 does not transmit the signal information on the second and third traffic lights 12 and 13 over the running road 20.

Next, a description will be given of the driving assistance device built in the vehicle 10 and a signal information processing device for a vehicle of the driving assistance device with reference to FIG. 3.

Figure 3:
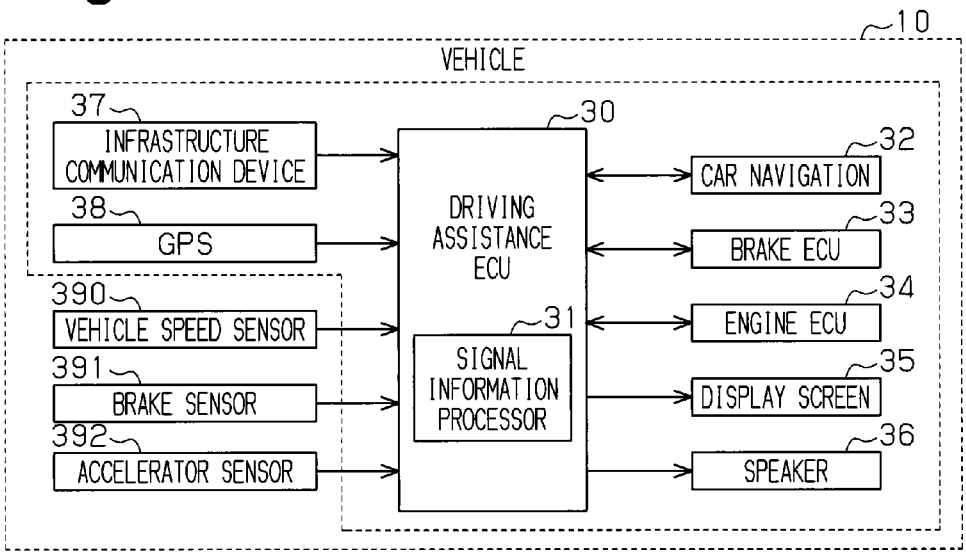
FIG. 3 is a block diagram exemplarily illustrating a general configuration of the signal information processing device built in a vehicle in FIG. 1 and that of the driving assistance device.

As illustrated in FIG. 3, the vehicle 10 is provided with a driving assistance ECU 30 that is a driving assistance control computer performing various controls relating to a driving assistance to the vehicle 10. In this embodiment, the driving assistance ECU 30 serves as the signal information processing device for a vehicle. The driving assistance ECU 30 is electrically coupled with various information obtaining devices, such as an infrastructure communication device 37 and a global positioning system (GPS) 38.

The infrastructure communication device 37 obtains various information from signals received from the wireless beacon 15 through optical receiver (not shown), and outputs received various information to the driving assistance ECU 30. Hence, the driving assistance ECU 30 is capable of learning a variety of information. For example, the infrastructure communication device 37 receives road traffic information divided from a management center like a VICS (Vehicle Information and Communication System) center through the wireless beacon 15. The variety of information includes information transmitted from the collective control device 17 of the first intersection 21 where the wireless beacon 15 is provided, i.e., the signal information and position information of the first traffic light 11, the signal lag F2 and position information of the second traffic light 12, and the signal lag F3 and position information of the third traffic light 13.

The GPS 38 receives GPS satellite signals to detect the absolute position of the vehicle 10, and detects a current position of the vehicle 10 based on the received GPS satellite signals. The GPS 38 outputs information on the detected current position of the vehicle 10 to the driving assistance ECU 30. This makes it possible for the driving assistance ECU 30 to learn the current position of the vehicle 10, and to detect the travel direction D of the vehicle 10 based on a change in time of the current position detected by the GPS 38.

Moreover, the driving assistance ECU 30 is electrically coupled with various sensors, such as a vehicle speed sensor 390, a brake sensor 391, and an accelerator sensor 392. The vehicle speed sensor 390 detects, for example, the rotation speed of an axle or a wheel, and outputs a signal corresponding to the detected rotation speed to the driving assistance ECU 30. Hence, the driving assistance ECU 30 is capable of learning the moving speed (speed V1) of the vehicle 10 and the moving distance. The brake sensor 391 detects, for example, presence/absence of a brake pedal operation by the driver (driver) and the depress level of the brake pedal, and, outputs signals corresponding to the detected presence/absence of the operation and the depress level to the driving assistance ECU 30. The accelerator sensor 392 detects presence/absence of an accelerator pedal operation by the driver and the depress level of the accelerator pedal, and, outputs signals corresponding to the detected presence/absence of the operation and the depress level to the driving assistance ECU 30.

According to such a configuration, the driving assistance ECU 30 is capable of calculating a current position based on the current position and travel direction D detected by the GPS 38 and the moving speed (speed V1) and moving distance detected by the vehicle speed sensor 390, and the like.

The driving assistance ECU 30 is connected with a brake control computer, which controls the braking, of the vehicle 10, i.e., a brake ECU 33, and an engine control computer that controls the engine of the vehicle 10, i.e., an engine ECU 34, respectively, in a communicable manner. The ECUs 33 and 34 are each a microcomputer mainly including a CPU that performs various calculations, a ROM storing various control programs, a RAM utilized as a work area for storing data and executing a program, an input/output interface, and a memory.

The brake ECU 33 is an ECU that controls the braking devices of the vehicle 10, and the brake ECU 33 is coupled with various sensors, such as the vehicle speed sensor 390 and the brake sensor 391. The brake ECU 33 generates braking force to the vehicle 10 through a control on the braking devices of the vehicle 10 based on signals from the various sensors. More specifically, the brake ECU 33 calculates required braking force based on the speed of the vehicle 10 learned by signals from the vehicle speed sensor 390, the brake depress level from the brake sensor 391, and the like, thereby controlling the braking devices. In this embodiment, the brake ECU 33 is also capable of performing a control to assist the deceleration and stopping of the vehicle 10, e.g., a preliminary braking and an assist braking when deceleration assist signals for a driving assistance like a run stopping assistance for the vehicle 10 is transmitted from the driving assistance ECU 30.

The engine ECU 34 is an ECU to control an operation of the engine of the vehicle 10. The engine ECU 34 is coupled with the accelerator sensor 392 that detects an accelerator depress level, a sensor that detects an intake air volume, and the like, and is also coupled with drive circuits of various devices, such as a drive circuit for a throttle valve, and a drive circuit for a fuel injection valve. The engine ECU 34 learns an engine operation condition based on detection signals input from the respective sensors, and outputs instruction signals to the respective drive circuits of various devices. Hence, an engine operation control is performed through the engine ECU 34. In this embodiment, when a deceleration assist signal for a driving assistance like a run stopping assist is transmitted from the driving assistance ECU 30, the engine ECU 34 performs a control to assist the deceleration and stopping of the vehicle 10. For example, the engine ECU 34 is capable of performing a control to suppress the engine rpm, and to terminate a fuel supply to the engine (fuel cut-off operation).

Moreover, electrically coupled with the driving assistance ECU 30 are a display screen 35 and a speaker 36, which are output devices (human machine interfaces) to output various information like an alert for a driving assist for the driver.

The display screen 35 is, for example, a liquid crystal display. The display screen 35 displays images corresponding to image data and the like input from the driving assistance ECU 30. Accordingly, the driving assistance ECU 30 is capable of outputting information relating to a driving assist like an attention display and an alert display for causing the driver to pay attention through the display screen 35.

The speaker 36 is a device that generates sounds and voices, and outputs sounds and voices corresponding to sound/voice data input from the driving assistance ECU 30. Hence, the driving assistance ECU 30 is capable of outputting, through the speaker 36, attention voices and alert sounds for causing the driver to paying an attention as information on the driving assist.

The driving assistance ECU 30 is further coupled with a car navigation device 32. In this embodiment, the driving assistance ECU 30, the infrastructure communication device 37, the GPS 38, the car navigation device 32, the brake ECU 33, the engine ECU 34, the display screen 35, and the speaker 36 configure the driving assistance device. When the car navigation device 32 can serve as the display screen 35 and the speaker 36, it is unnecessary for the driving assistance device to have the display screen 35 and the speaker 36 as output devices separately from the car navigation device 32, and the display screen 35 and the speaker 36 may be omitted. Moreover, the output devices of the driving assistance device are not limited to the display screen 35 and the speaker 36.

The car navigation device 32 detects the current position of the vehicle 10 through the GPS 38 and refers to road map information stored in advance to guide for the driver a running route or the like of the vehicle 10 to a drive destination. The car navigation device 32 is provided with a display device (not shown), an input device, and a sound device. Moreover, the car navigation device 32 is provided with a HDD (Hard Disk Drive) (not shown) that is a nonvolatile memory device, and the HDD stores in advance various information like the road map information (map database) applied for a navigation process.

The road map information contains the shape of the running road 20, information on intersections and crosswalks in the road, and the like. More specifically, such information may contain information on the positions of intersections (e.g., first to third intersections 11 to 13) where the traffic lights are respectively provided, a road shape like the number of traffic lanes in the road and the width of traffic lanes, tunnels, crosswalks, points where accidents often occur, and the road condition. Information on the intersection contains the number of traffic lanes of the respective roads intersecting with each other, the traffic lane width of each road, and the like.

The driving assistance ECU 30 mainly includes a microcomputer having a CPU to execute various calculations, a ROM storing various control programs, a RAM utilized as a work area to store data or to execute a program, an input/output interface, a memory. The driving assistance ECU 30 retains parameters relating to the driving performance of the vehicle 10, such as a parameter relating to acceleration, and a parameter relating to deceleration like a deceleration Da when the accelerator pedal is OFF. Moreover, the driving assistance ECU 30 stores in advance various programs and various parameters necessary for a process of obtaining the green starting time point Cb1 from the signal information on the first traffic light 11, and a process of calculating the red starting time point Cr1. Furthermore, the driving assistance ECU 30 stores various programs and various parameters necessary for a process of calculating the green starting time point Cb12 from the signal information on the second traffic light 12, and a process of calculating the green starting time point Cb13 from the signal information on the third traffic light 13. The green starting time point Cb12 of the second traffic light 12 is calculated based on the green starting time point Cb1 of the first traffic light and the signal lag F2 of the second traffic light 12. Moreover, the green starting time point Cb13 of the third traffic light 13 is calculated based on the green starting time point Cb1 of the first traffic light 11 and the signal lag F3 of the third traffic light 13.

The driving assistance ECU 30 of this embodiment is provided with a signal information processor 31, which is a signal information estimating unit that estimates the red starting time point Cr12 of the second traffic light 12 and estimates the red starting time point Cr13 of the third traffic light 13. Furthermore, the driving assistance ECU 30 stores in advance various programs and various parameters to cause the signal information processor 31 to perform an estimation.

For example, the signal information processor 31 estimates the red starting time point Cr12 of the second traffic light 12 based on the signal cycle C1 of the first traffic light 11, the signal lag F2 of the second traffic light 12 and the driving environment at the second intersection 22 corresponding to the second traffic light 12. Moreover, the signal information processor 31 estimates the red starting time point Cr13 of the third traffic light 13 based on the signal cycle C1 of the first traffic light 11, the signal lag F3 of the third traffic light 13, and the driving environment at the third intersection 23 corresponding to the third traffic light 13.

In order to calculate the red starting time point Cr12 of the second traffic light 12, the value of the signal split time S2, which specifies the end of the green starting time point Cb12, is necessary. In this embodiment, however, no signal split time S2 is transmitted from the wireless beacon 15, and thus the driving assistance ECU 30 cannot obtain the signal split time S2 from the wireless beacon 15. Hence, the driving assistance ECU 30 is configured to estimate the signal split time S2 through the signal information processor 31. Likewise, in order to calculate the red starting time point Cr13 of the third traffic light 13, the value of the signal split time S3, which specifies the end of the green starting time point Cb13, is necessary. However, like the case in which the driving assistance ECU 30 is unable to obtain the signal split time S2 of the second traffic light 12 through the wireless beacon 15, the driving assistance ECU is unable to obtain the signal split time S3 through the wireless beacon 15. Hence, the driving assistance ECU 30 is configured to estimate the signal split time S3 through the signal information processor 31. In this embodiment, the driving assistance ECU 30 estimates the ratio of the division of the respective signal split times S1 to S3 in the total signal split time such that the signal split times of the respective traffic signals 11 to 13 do not hamper the traffic at the roads 20, 20A, 20B, and 20C intersecting with each other as much as possible, i.e., in such a manner as not to increase the number of vehicles waiting for the signal at the intersection as much as possible. That is, the driving assistance ECU 30 estimates the respective signal split times S1 to S3 to keep in line with the collective control device 17.

In this embodiment, as a presumption for estimating the signal split times S1 to S3, the driving assistance ECU 30 presumes that the traffic of the running road 20 increases or decreases depending on the number of traffic lanes of the road. Moreover, the driving assistance ECU 30 presumes that the respective traffics of the two roads intersecting with each other at the intersection increase or decrease depending on the number of traffic lanes based on the former presumption. Hence, the driving assistance ECU 30 presumes that the ratio of the traffics of the two roads intersecting with each other satisfies a relationship depending on the ratio of the number of traffic lanes, and estimates that the total signal split time is divided to the respective signal split times of the roads at the traffic lights in the intersection in accordance with the ratio of the number of traffic lanes of the two roads intersecting with each other.

Figure 4:
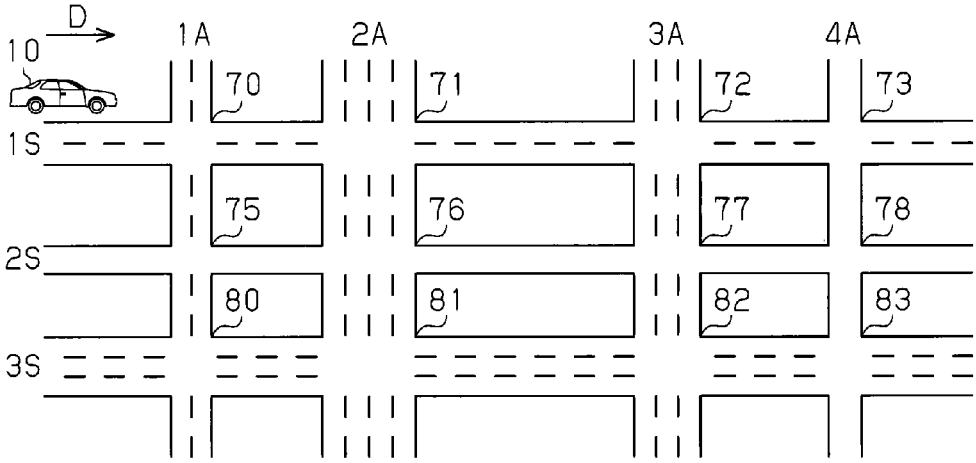
FIG. 4 is a driving environment model diagram possessed by the signal information processing device in FIG. 3 to learn the running condition to be considered when estimating a signal split time.
Figures 5, 6:
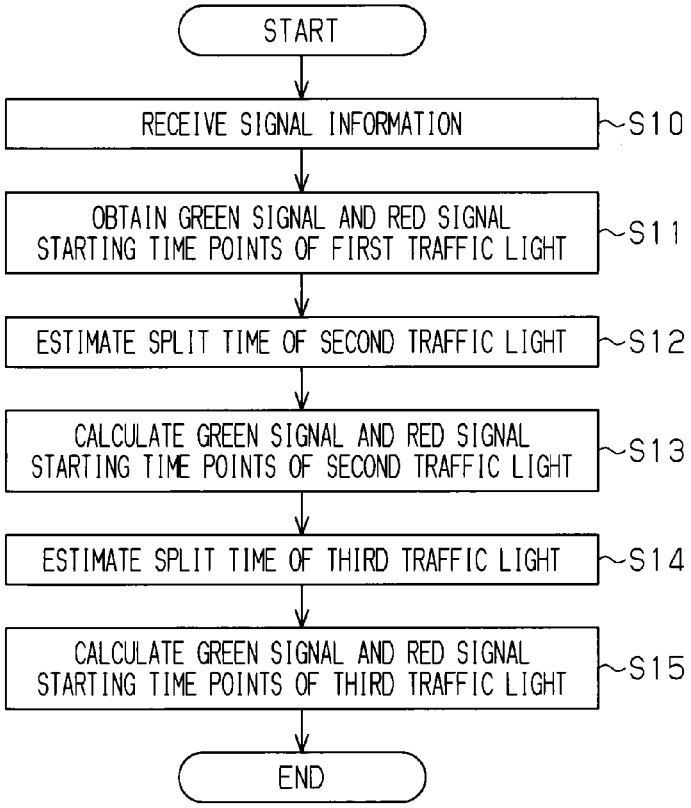
FIG. 5 is a table possessed by the signal information processing device to estimate a signal split time in the driving environment in FIG. 4 and to learn the relationship with a cross-road for each intersection.
FIG. 6 is a flowchart illustrating steps of a split time estimating process by the signal information processing device in FIG. 3.

FIGS. 4 and 5 illustrate an example of intersections and the ratio of the number of traffic lanes between two roads intersecting with each other at the individual intersection. In the case of, for example, an intersection 70 illustrated at the upper left in FIG. 4, a horizontal road 1S with two traffic lanes and a vertical road 1A with two traffic lanes intersect with each other. Hence, as is indicated in table 90 in FIG. 5, the ratio of the number of traffic lanes is 2:2. Accordingly, the driving assistance ECU 30 estimates that the total signal split time at the intersection 70 is divided by the collective control device 17 at a ratio of: the signal split time of the horizontal road 1S:the signal split time of the vertical road 1A=2:2, i.e., 1:1. Accordingly, the driving assistance ECU 30 can estimate the respective signal split times at the intersection 70, and can calculate the red starting time point of the traffic light at the intersection 70 based on the estimated signal split time and the green starting time point of the traffic light in the travel direction of the vehicle 10.

Likewise at an intersection 71, the horizontal road 1S with two traffic lanes and a vertical road 2A with four traffic lanes intersect with each other, and thus the ratio of the number of traffic lanes is 2:4. Accordingly, the driving assistance ECU 30 estimates that the total signal split time of the traffic lights is divided by the collective control device 17 such that the horizontal signal split time: the vertical signal split time is the ratio of 2:4, i.e., 1:2. Moreover, at an intersection 72, the horizontal road 1S with two traffic lanes and a vertical road 3A with three traffic lanes intersect with each other, and thus the ratio of the number of traffic lanes is 2:3. Accordingly, the driving assistance ECU 30 estimates that the collective control device 17 divides the total signal split time of the traffic lights at the ratio of 2:3. Furthermore, at an intersection 73, the horizontal road 1S with two traffic lanes and a vertical road 4A with one traffic lane intersect with each other, and thus the ratio of the number of traffic lanes is 2:1. Accordingly, the driving assistance ECU 30 estimates that the total signal split time of the traffic lights is divided by the collective control device 17 at a ratio of 2:1.

Likewise, at an intersection 75, a horizontal road 2S with one traffic lane and the vertical road 1A with two traffic lanes intersect with each other, and thus the ratio of the number of traffic lanes is 1:2. Accordingly, the driving assistance ECU 30 estimates that the collective control device 17 divides the total signal split time of the traffic lights at the ratio of 1:2. At an intersection 76, the horizontal road 2S with one traffic lane and the vertical road 2A with four traffic lanes intersect with each other, and thus the ratio of the number of traffic lanes is 1:4. Accordingly, the driving assistance ECU 30 estimates that the collective control device 17 divides the total signal split time of the traffic lights at the ratio of 1:4. At an intersection 77, the horizontal road 2S with one traffic lane and the vertical road 3A with three traffic lanes intersect with each other, and thus the ratio of the number of traffic lanes is 1:3. Accordingly, the driving assistance ECU 30 estimates that the collective control device 17 divides the total signal split time of the traffic lights at the ratio of 1:3. Moreover, at an intersection 78, the horizontal road 2S with one traffic lane and the vertical road 4A with one traffic lane intersect with each other, and thus the ratio of the number of traffic lanes is 1:1. Accordingly, the driving assistance ECU 30 estimates that the collective control device 17 divides the total signal split time of the traffic lights at the ratio of 1:1.

Furthermore, at an intersection 80, a horizontal road 3S with three traffic lanes and the vertical road 1A with two traffic lanes intersect with each other, and thus the ratio of the number of traffic lanes is 3:2. Accordingly, the driving assistance ECU 30 estimates that the collective control device 17 divides the total signal split time of the traffic lights at the ratio of 3:2. At an intersection 81, the horizontal road 3S with three traffic lanes and the vertical road 2A with four traffic lanes intersect with each other, and thus the ratio of the number of traffic lanes is 3:4. Accordingly, the driving assistance ECU 30 estimates that the collective control device 17 divides the total signal split time of the traffic lights at the ratio of 3:4. At an intersection 82, the horizontal road 3S with three traffic lanes and the vertical road 3A with three traffic lanes intersect with each other, and thus the ratio of the number of traffic lanes is 3:3. Accordingly, the driving assistance ECU 30 estimates that the collective control device 17 divides the total signal split time of the traffic lights at the ratio of 3:3, i.e., 1:1. Moreover, at an intersection 83, the horizontal road 3S with three traffic lanes and the vertical road 4A with one traffic lane intersect with each other, and thus the ratio of the number of traffic lanes is 3:1. Accordingly, the driving assistance ECU 30 estimates that the collective control device 17 divides the total signal split time of the traffic lights at the ratio of 3:1.

A description will be given of an operation of the signal information processor 31 employing the above-described configuration with reference to FIG. 6.

As illustrated in FIG. 6, when detecting the wireless beacon 15 through the infrastructure communication device 37, the driving assistance ECU 30 starts communicating with the wireless beacon 15, and receives, for example, signal information on the traffic light from the wireless beacon 15 (step S10). More specifically, the driving assistance ECU 30 obtains, from the wireless beacon 15, the signal information on the first traffic light 11, the signal lag F2 of the second traffic light 12, and the signal lag F3 of the third traffic light 13. The signal information on the first traffic light 11 contains the "position information," the green starting time point Cb1, the signal split time S1, and the signal cycle C1.

The driving assistance ECU 30 obtains, based on the received signal information on the traffic light the green starting time point Cb1 of the first traffic light 11 and the red starting time point Cr1 thereof through the signal information processor 31 (step S11). The signal information processor 31 obtains the green starting time point Cb1 from the signal information on the first traffic light 11, and obtains the red starting time point Cr1 by adding the obtained signal split time S1 to the green starting time point Cb1 obtained from the signal information on the first traffic light 11.

Next, the signal information processor 31 of the driving assistance ECU 30 estimates the signal split time S2 of the second traffic light 12 (step S12). The signal split time S2 is estimated such that the total signal split time is divided with reference to corresponding data in FIGS. 4 and 5 based on the ratio of the number of traffic lanes of the running road 20 at the second intersection 22 and the number of traffic lanes of the cross-road 20B intersecting with the running road 20. In this embodiment, the signal information processor 31 obtains the number of traffic lanes of the running road 20 at the second intersection 22 and the number of traffic lanes of the road intersecting with the running road 20 from the road map information. That is, the position of the second intersection 22 next to the first intersection 21 is specified based on the position of the first intersection 21 specified from the "position information" of the first traffic light 11 and the travel direction D. Subsequently, the signal information processor 31 obtains the driving environment corresponding to the second intersection 22 thus specified from the road map information.

Next, the signal information processor 31 of the driving assistance ECU 30 obtains the green starting time point Cb12 and the red starting time point Cr12 (step S13). The signal information processor 31 obtains the green starting time point Cb12 by adding the signal lag F2 of the second traffic light 12 to the green starting time point Cb1 of the first traffic light 11, and obtains the red starting time point Cr12 by adding the estimated signal split time S2 to the obtained green starting time point Cb12.

Likewise, the signal information processor 31 of the driving assistance ECU 30 estimates the signal split time S3 of the third traffic light 13 (step S14). The signal split time S3 is estimated such that the total signal split time is divided based on the ratio between the number of traffic lanes of the running road 20 at the third intersection 23 and the number of traffic lanes of the cross-road 20C intersecting the running road 20 with reference to corresponding data in FIGS. 4 and 5. The position of the third intersection 23, which is two blocks ahead of the first intersection 21, is specified based on the specified position of the first intersection 21 and the travel direction D. Next, the driving environment corresponding to the third intersection 23 specified in this manner is obtained from the road map information.

Subsequently, the signal information processor 31 of the driving assistance ECU 30 obtains the green starting time point Cb13 and the red starting time point Cr13 (step S15). The green starting time point Cb13 is obtainable by adding the signal lag F3 of the third traffic light 13 to the green starting time point Cb1 of the first traffic light 11 through the signal information processor 31, and the red starting time point Cr13 is obtainable by adding the estimated signal split time S3 to the calculated green starting time point Cb13 through the signal information processor 31.

Hence, the driving assistance ECU 30 obtains the signal information on the first to third traffic lights 11 to 13 and thus completes the driving the process for obtaining signal information on the first to third traffic lights 11 to 13. Moreover, the signal information on the first to third traffic lights 11 to 13 obtained in this manner is utilized for driving assist, such as run stopping assist for the vehicle 10 in relation to the first to third traffic lights 11 to 13 and a passing assist there through, by the driving assistance ECU 30.

Hence, a description will be given of a driving assist by the driving assistance ECU 30 based on the obtained signal information with reference to FIG. 7. In this example, in order to facilitate understanding, run stopping assist for the second traffic light 12 will be described, and the description for a driving assist for the vehicle in relation to the first and third traffic lights 11 and 13 will be omitted.

Figure 7:
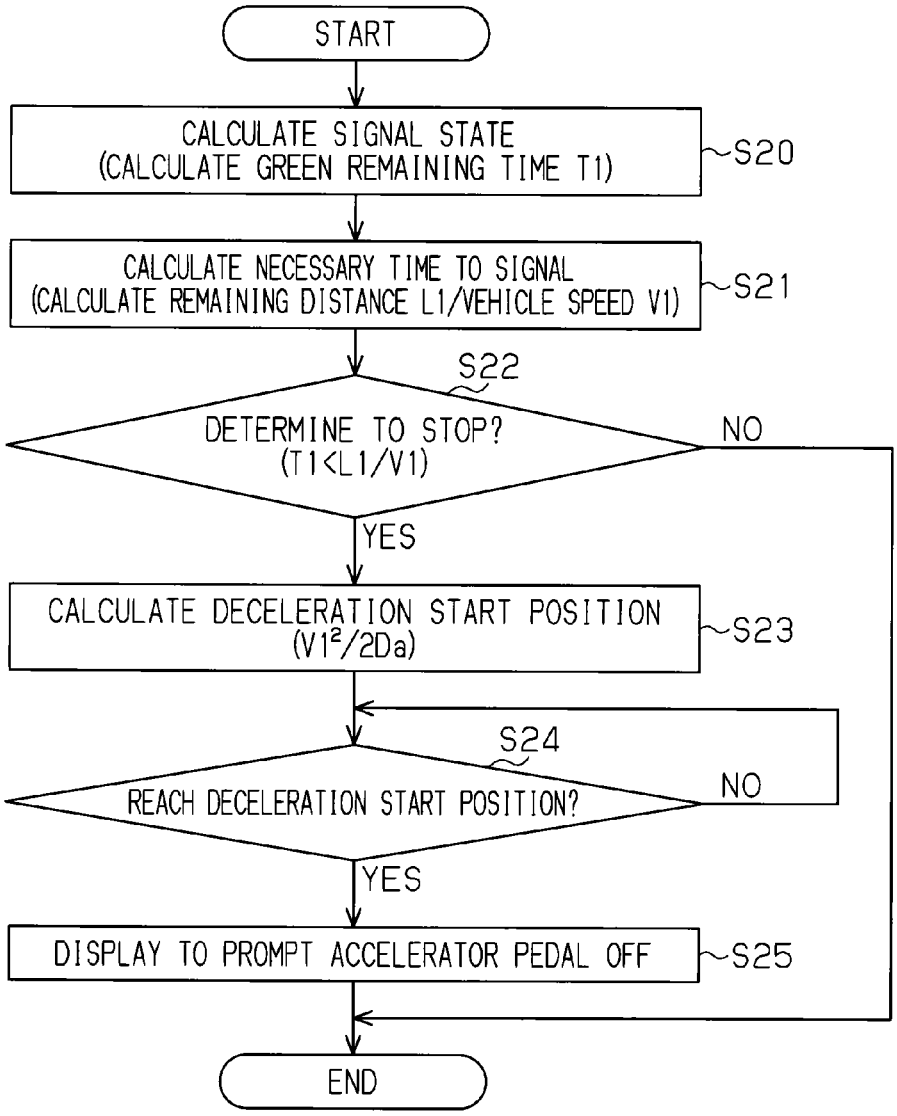
FIG. 7 is a flowchart illustrating steps of a run stopping assistance process by the driving assistance device including the signal information processing device in FIG. 3.

As illustrated in FIG. 7, when driving assist for the vehicle in relation to the second traffic light 12 starts, the driving assistance ECU 30 calculates a signal state of the second traffic light 12 (step S20 in FIG. 7). That is, the driving assistance ECU 30 calculates the remaining time (green remaining time T1) of the green signal G of the second traffic light 12 based on the green starting time point Cb12 of the second traffic light 12 and a time calculated on the basis of, for example, a clock installed in the vehicle 10 or the GPS 38. At this time, the driving assistance ECU 30 calculates a necessary time to reach the second traffic light 12 from the current position of the vehicle 10 (step S21). That is, the driving assistance ECU 30 calculates a remaining distance L1 based on the current position of the vehicle 10 and the position of the second traffic light 12 obtained from the road map information, and divides the calculated remaining distance L1 by a current vehicle speed V1 of the vehicle 10, thereby calculating a necessary time (L1/V1) for the vehicle 10 to reach the second traffic light 12 when maintaining the current vehicle speed V1.

When the green remaining time T1 and the necessary time are calculated, the driving assistance ECU 30 determines whether or not to perform run stopping assist on the vehicle 10 (step S22). Whether or not to perform the run stopping assist is determined by the driving assistance ECU 30 based on whether or not the necessary time is longer than the green remaining time T1. That is, when the necessary time L1/V1 is shorter than the green remaining time T1 (L1/V1<T1), the vehicle 10 can pass through the second traffic light 12 during the green signal G, and thus the driving assistance ECU 30 determines that no run stopping assist is necessary (step S22: NO). Hence, the driving assistance ECU 30 terminates the run stopping assist without performing the run stopping assist.

In contrast, when the necessary time is longer than the green remaining time T1 (T1<L1/V1), if the vehicle 10 keeps running at the current vehicle speed V1, the second traffic light 12 will be the red signal R or the yellow signal Y when the vehicle reaches the second traffic light 12, and thus the vehicle 10 cannot pass through the second traffic light 12. Accordingly, the driving assistance ECU 30 determines to perform the run stopping assist (step S22: YES). When determining to perform the run stopping assist, the driving assistance ECU 30 calculates a deceleration start position of the vehicle 10 (step S23). The deceleration start position is calculated based on, for example, a formula (vehicle speed V1×vehicle speed V1)/(2×deceleration Da when accelerator pedal is OFF). This formula is based on a model case in which the vehicle 10 stops at the second traffic light 12 if the deceleration Da is maintained after starting decelerating at the deceleration Da at a location distant from the second traffic light 12 by the distance corresponding to the deceleration start position. The driving assistance ECU 30 compares the calculated deceleration start position and the current position of the vehicle 10, and determines whether or not the vehicle 10 has already reached the deceleration start position (step S24). When determining that the vehicle 10 has not yet reached the deceleration starting time point (step S24: NO), the driving assistance ECU 30 repeatedly determines whether or not the vehicle 10 has reached the deceleration start position after a predetermined time.

Next, when determining that the vehicle 10 has reached the deceleration start position (step S24: YES), the driving assistance ECU 30 displays an indication to prompt the driver to release the accelerator pedal on the display screen 35 to assist the stopping of the vehicle 10 (step S25). The stop assist may be performed through a notification of causing the driver to pay attention via voices, a preliminary braking or an assist braking by the brake ECU 33, engine speed suppression by the engine ECU 34, a fuel cut-off operation, or a combination thereof.

Thereafter, when the vehicle 10 has reached a position right before the second traffic light 12 by a predetermined distance, the driving assistance ECU 30 terminates the run stopping assist. Accordingly, the run stopping assist for the vehicle 10 in relation to the second traffic light 12 completes.

(Operation)

Next, an operation of the driving assistance device of this embodiment will be described.

As illustrated in the left of FIG. 1, when the vehicle 10 travels the running road 20 in the travel direction D, and when the vehicle 10 reaches a position right before the first traffic light 11, the driving assistance ECU 30 of the vehicle 10 obtains the signal information of the first traffic light 11 from the wireless beacon 15. Next, the driving assistance ECU 30 determines whether or not to perform a run stopping assist for the vehicle 10 in relation to the first traffic light 11 based on the flowchart of the run stopping assist process of FIG. 7. That is, the driving assistance ECU 30 determines whether or not to perform a run stopping assist for the vehicle 10 in relation to the first traffic light 11 based on the signal split time S1 (green time) of the green signal G of the first traffic light 11 obtainable from the obtained information, a time (red time) "C1-S1" at which the red signal R and the yellow signal Y is indicated and displayed, and a current vehicle speed 41 of the vehicle 10 obtained from the vehicle speed sensor 390. When determining that the vehicle 10 will reach the first traffic light 11 during the red time if the vehicle 10 maintains a maintained vehicle speed 42, which is a running speed obtained when the current vehicle speed 41 is maintained and travels forward, the driving assistance ECU 30 determines to perform a run stopping assist. When the run stopping assist is performed, the driving assistance ECU 30 starts the run stopping assist when the vehicle 10 reaches the deceleration start position, and prompts the driver to release the accelerator pedal to decelerate the speed of the vehicle 10 to a stopping assist vehicle speed 43.

In FIG. 1, the horizontal axis indicates a distance, while the downward vertical axis indicates a time. Accordingly, a slope of an arrow indicating, for example, the current vehicle speed 41 with respect to the downward vertical axis shows the largeness of the current vehicle speed 41. That is, since the current vehicle speed 41 and the maintained vehicle speed 42 have the same slope in FIG. 1, both speeds are the same vehicle speed. In FIG. 1, the closer to the horizontal line the arrow, the faster the vehicle speed becomes, and the more downward the arrow, the slower the vehicle speed becomes. That is, the stopping assist vehicle speed 43 with a sharper downward arrow than that of the current vehicle speed 41 indicates that the speed is slower than the current vehicle speed 41. The stopping assist vehicle speed 43 reaches "zero" at the first traffic light 11, and thus the stopping assist vehicle speed 43 should be indicated by a curved line convex upwardly, but in order to simplify the description, in FIG. 1, the stopping assist vehicle speed 43 is indicated by a straight line arrow. In contrast, a vehicle 10A indicated below the vehicle 10 in FIG. 1 is a following vehicle to the vehicle 10 on the running road 20. That is, when the vehicle 10A keeps running at a same maintained vehicle speed 47 as a current vehicle speed 46 toward the first traffic light 11, such a vehicle reaches the first traffic light 11 around the end of red time of the first traffic light 11. That is, it is determined that the vehicle 10A reaches the first traffic light 11 during the red time of the first traffic light 11, but can reach the first traffic light 11 during the next green time if decelerated. The driving assistance ECU 30 determines to perform a passing assist for such a vehicle 10A through the first traffic light 11. When determining to perform the passing assist, the driving assistance ECU 30 starts the passing assist for the vehicle 10A upon reaching of the vehicle 10A to the deceleration start position. That is, the driving assistance ECU 30 prompts the driver to release the accelerator pedal to decelerate the speed of the vehicle 10 to a passing assist vehicle speed 48 from the current vehicle speed 46.

Moreover, a vehicle 10B illustrated in the right of FIG. 1 has, for example, passed through the first traffic light 11 and the second traffic light 12, and is running at a position before the third traffic light 13. The vehicle 10B, which is running before the third traffic light 13, determines, based on the green time and red time of the third traffic light 13 estimated through the flowchart of FIG. 6 based on the signal information on the first traffic light 11 and the signal lag F3 of the third traffic light 13 obtained from the wireless beacon 15 before the first traffic light 11, and a current vehicle speed 51 of the vehicle 10B, whether or not to perform a run stopping assist in relation to the third traffic light 13 through the flowchart of FIG. 7. When determining that the vehicle 10B will reach the third traffic light 13 if the vehicle keeps running at a maintained vehicle speed 52, which is the current vehicle speed 51 maintained as it is, the driving assistance ECU 30 determines to perform a run stopping assist for the vehicle 10B. When performing the run stopping assist, the driving assistance ECU 30 of the vehicle 10B starts the run stopping assist upon reaching of the vehicle 10B to the deceleration start position, and prompts the driver to decelerate the speed of the vehicle 10B to a stopping assist vehicle speed 53 from the current vehicle speed 51.

In contrast, a vehicle 10C indicated below the vehicle 10B in FIG. 1 is a following vehicle to the vehicle 10B on the running road 20. Like the vehicle 10A, if the vehicle 10B keeps running toward the third traffic light 13 at a maintained vehicle speed 57, which is a maintained current vehicle speed 56, the vehicle will reach the third traffic light 13 during the red time, but if decelerated, will reach the third traffic light 13 during the next green time. When determining so, the driving assistance ECU 30 of the vehicle 10C determines to perform a passing assist for the vehicle 10C to cause the vehicle 10C to pass through the third traffic light 13. When determining to perform the passing assist, the driving assistance ECU 30 starts the passing assist upon the reaching of the vehicle 10C to the deceleration start position relative to the third traffic light 13, and prompts the driver to decelerate the speed of the vehicle 10C to a passing assist vehicle speed 58 from the current vehicle speed 56.

As described above, the driving assistance ECU 30 of this embodiment provides a driving assist for the vehicle 10B and the vehicle 10C in relation to even the third traffic light 13 corresponding to the signal information that cannot be directly obtained from the roadside device by estimating the signal information on the third traffic light 13 like the driving assist provided to the vehicle 10 and the vehicle 10A in relation to the first traffic light 11 with the signal information directly obtainable. The driving assistance device with the driving assistance ECU 30 as the signal information processing device for a vehicle can suitably provide a driving assist for the vehicle 10 in relation to a traffic light in the vehicle 10.

As described above, the driving assistance ECU 30 as the signal information processing device for a vehicle of this embodiment achieves the following advantages.

(1) The driving assistance ECU 30 estimates the signal information (signal split time S2) of the second traffic light 12 through a calculation based on the obtained signal information on the first traffic light 11 and the obtained information indicating the driving environment at the second traffic light 12. This enables the driving assistance ECU 30 to obtain, through estimation, the signal information on the second and third traffic lights 12 and 13, which are not transmitted from the roadside device. Hence, the driving assistance ECU 30 is capable of performing a driving assist for the vehicle 10 in relation to even the traffic lights 12 and 13 corresponding to signal information, which cannot be directly obtained from the roadside device.

The driving assistance ECU 30 can obtain signal information that is necessary for a driving assistance although the signal information on the second traffic light 12 is not transmitted from the roadside device. Hence, signal information transmitted by the wireless beacon 15 can be reduced.

(2) The operations of the traffic lights 11 to 13 provided at respective intersections are often adjusted by, for example, the collective control device 17 to meet the driving environments at the multiple road 20 to 20C intersecting with each other. Hence, the driving assistance ECU 30 estimates the signal information on the second traffic light 12 provided at the second intersection 22 through a calculation based on the information on the driving environment at the second intersection 22 and the signal information corresponding to the first traffic light 11. This enables the driving assistance ECU 30 to suitably perform a driving assist for the vehicle 10 in relation to the second traffic light 12 at the second intersection 22, which is an estimation target.

(3) The number of vehicles passing through an intersection often increases or decreases depending on the increase or the decrease of the number of traffic lanes at the intersection. Hence, the driving assistance ECU 30 is made to estimate the signal information on the second traffic light 12 provided at the second intersection 22 based on the number of traffic lanes of each road 20, 20B intersecting at the second intersection 22 through, for example, comparing the respective numbers of traffic lanes of those roads 20 and 20B with each other. This enables the driving assistance ECU 30 to appropriately perform a driving assist for the vehicle 10 in relation to the second traffic light 12 of the second intersection 22, which is an estimation target.

(4) The driving assistance ECU 30 estimates an instruction period (green time or red time), in which the second traffic light 12 instructs the vehicle 10 to move forward or stop, i.e., a signal split time based on information on the driving environment at the second traffic light 12. This makes it possible for the driving assistance ECU 30 to appropriately estimate a signal split time suitable for the driving environment, i.e., a signal split time that is highly likely to be set for the second traffic light 12 under such a driving environment.

(5) The driving assistance ECU 30 obtains the green starting time point Cb12 of the second traffic light 12 as described above and also obtains the ending time point of the green signal G. That is, the ending time point of this green signal G corresponds to the starting time point (i.e., red starting time point Cr12) of a stop instruction (red signal R or yellow signal Y) by the second traffic light 12. This enables the driving assistance ECU 30 to perform a run stopping assist or the like that is a driving assist performed based on the starting time point of the stop instruction. Accordingly, the applicable fields of the signal information processing device in a driving assistance device are expanded.

(6) In general, in the case of a signal group in which the multiple traffic lights 11 to 13 have respective green starting time points Cb1, Cb12, and Cb13 cooperatively controlled by the collective control device 17, an effective cooperative control is performed such that the period of the green signal G of those traffic lights 11 to 13, i.e., the signal cycle C1 is synchronized by the collective control device 17. Accordingly, the time interval of the green signal G in the signal information on the second traffic light 12, i.e., the signal split time S2 is highly probably equal to the time interval for repeating the green signal G in the signal information on the first traffic light 11. Hence, the driving assistance ECU 30 utilizes the time interval for repeating the green signal G in the signal information on the first traffic light 11 as the time interval for repeating the green signal G of the second traffic light 12, thereby appropriately estimating the signal information on the second traffic light 12.

(7) The signal information processor 31 is built in the vehicle 10. Hence, the signal information on the second traffic light 12 estimated by the signal information processor 31 can be easily utilized by the vehicle 10. That is, in a driving assist for the vehicle 10, the usefulness of the signal information on the second traffic light 12 estimated in this manner by the signal information processor 31 is enhanced.

(Other Embodiments)

The above-described embodiment may be carried out in the following forms.

In the above-described embodiment, the description is given of an example case in which the first to third traffic lights 11 to 13 are provided at the first to third intersections 21 to 23, respectively. The present invention is, however, not limited to this case, and it is fine if a traffic light is provided at a location where the passing of the vehicle in the travel direction is promoted or is inhibited, and may be provided at other locations than an intersection, e.g., a merging point of multiple roads, a crosswalk, and a railroad crossing. The signal information processing device for a vehicle and a driving assistance device of the present invention may be configured to cope with such traffic lights 11 to 13, and thus the applicability of the signal information processing device for a vehicle is improved.

In the above-described embodiment, the description is given of an example case in which the collective control device 17 is provided at the first traffic light 11, but the present invention is not limited to this case. The collective control device 17 may be separately provided from the first traffic light as long as a transmission of a control signal to the first traffic light is possible. The signal information processing device for a vehicle and driving assistance device of the present invention may be configured to cope with such traffic lights 11 to 13. This allows the driving assistance device with the signal information processing device for a vehicle is to be applied to a wider range of types or roads.

In the above-described embodiment, the description is given of an example case in which the collective control device 17 provided at the first traffic light 11 collectively calculates the respective green starting time points Cb12 and Cb13 of the second and third traffic lights 12 and 13. The present invention is, however, not limited to this case, and the green starting time point of the second traffic light and that of the third traffic light may be calculated at the second traffic light and the third traffic light, respectively. In this case, the collective control device transmits, to the respective traffic lights, a time difference between the green starting time point of the first traffic light and the green starting time point of the respective traffic lights relative to the green starting time point of the first traffic light, i.e., a signal lag. This enables the roadside devices at the respective traffic lights 12 and 13 to calculate the green starting time point of the traffic lights 12 and 13 in synchronization with the green starting time point of the first traffic light 11. The signal information processing device for a vehicle and driving assistance device of the present invention can be configured to cope with such traffic lights 11 to 13. This allows the driving assistance device with the signal information processing device for a vehicle to be applied to a wider range of types of roads.

In the above-described embodiment, the description is given of an example case in which the collective control device 17 divides the total signal split time to the running road 20 and the cross-road 20A such that the number of vehicles waiting for a signal in the running road 20 and the number of vehicles waiting for a signal in the cross-road 20A at the first intersection 21 are minimized. The present invention is, however, not limited to this case, and when the collective control device 17 divides the total signal split time, the collective control device may give a priority to the traffic at one of the roads, or may consider other factors like the passing speed of vehicles, and such other factors may be considered in a combined manner. Moreover, the collective control device 17 may mechanically define the division of the total signal split time in accordance with a driving environment regardless of the number of vehicles waiting for a signal. The signal information processing device for a vehicle and driving assistance device of the present invention can be configured to cope with such traffic lights 11 to 13. This allows the driving assistance device with the signal information processing device for a vehicle to be applied to a wider range of types of roads.

FIG. 5 of the above-described embodiment exemplarily illustrates a case in which the driving assistance ECU 30 obtains the ratio of the division of the total signal split time as a ratio of the number of traffic lanes. The present invention is, however, not limited to this case, and the driving assistance ECU 30 may multiply the number of traffic lanes by a predetermined coefficient, or may obtain the ratio of the distribution based on a weight set to correspond to the number of traffic lanes, in addition to the obtainment of the ratio of the number of traffic lanes when obtaining the ratio of the division of the total signal split time. When, for example, using a weight, the driving assistance ECU 30 may set the weight of a road with a traffic lane to be "0.67", the weight of a road with two traffic lanes to be "1", and the weight of a road with three traffic lanes to be "1.5". In this case, when a road with a traffic lane and a road with two traffic lanes intersect with each other, the driving assistance ECU 30 obtains that the ratio of division is 0.67:1, i.e., 2:3. Likewise, the driving assistance ECU 30 obtains that the ratio of division is 0.67:1.5, i.e., 2:5 when a road with a traffic lane and a road with three traffic lanes intersect with each other, and that the ratio of division is 1:1.5, i.e., 2:3 when a road with two traffic lanes and a road with three traffic lanes intersect with each other. By configuring the driving assistance ECU 30 to operate as described above, the design flexibility of the signal information processing device for a vehicle is enhanced.

In the above-described embodiment, the description is given of a case in which the driving assistance ECU 30 performs a calculation to divide the total signal split time to the running road 20 and the cross-roads 20A, 20B, and 20C for each traffic light 11 to 13 in accordance with the driving environment as the signal split time of each road. The present invention is, however, not limited to this case, and the driving assistance ECU 30 may divide beforehand the total signal split time at a ratio set in advance as the signal split time of each road. When, for example, the total signal split time is divided in accordance with the number of traffic lanes of an intersecting road, the driving assistance ECU 30 may have a ratio of dividing the signal split time set in advance. In practice, it is difficult to calculate an optimized division ratio of the signal split time in consideration of the traffic of an oncoming traffic lane and the traffic at a cross-road. Hence, the driving assistance ECU 30 may have the ratio of the signal split time set in advance, and may have the variable range of the ratio of the signal split time limited to a certain range when the ratio of the signal split time is made variable. The driving assistance ECU 30 can be configured to cope with this, and thus the flexibility of the structure of the signal information processing device for a vehicle and that of the driving assistance device improve.

In the above-described embodiment, the description is given of an example case in which the wireless beacon 15 is an optical beacon. The present invention is, however, not limited to this case, and the wireless beacon may be a beacon that uses radio waves as long as it is communicable with a vehicle. In this case, the vehicle may be provided with a receiver that can receive transmitted signals from the wireless beacon. This allows the signal information processing device for a vehicle to be applied to a wider range of types of roads.

Although the description is given of an example case in which the wireless beacon 15 is provided in a manner corresponding to the first traffic light 11 in the above-described embodiment, the present invention is not limited to this case, and the driving assistance ECU 30 may obtain information on the traffic lights 11 to 13 from other infrastructure devices, such as a VICS center and a probe information center. This allows the signal information processing device to be applied to a wider range of types or roads.

In the above-described embodiment, the description is given of an example case in which the driving assistance ECU 30 performs a run stopping assist or a passing assist for the vehicle 10 in relation to the traffic lights 11 to 13. The present invention is, however, not limited to this case, and the driving assistance ECU may perform other driving assists in relation to the traffic light. This enhances the applicability of the driving assistance device with the signal information processing device for a vehicle.

In the above-described embodiment, the description is given of an example case in which the driving assistance ECU 30 is coupled with the car navigation device 32, the brake ECU 33, the engine ECU 34, the display screen 35, and the speaker 36 to configure the driving assistance device. The present invention is, however, not limited to this case, and it is appropriate if the driving assistance ECU is coupled with at least one device utilized for a driving assist, such as a run stopping assist or a passing assist, in order to configure the driving assistance device. That is, it is appropriate if at least one of the car navigation, the brake ECU, the engine ECU, the display screen and the speaker is coupled with the driving assistance ECU 30, or other devices than those devices may be coupled with the driving assistance ECU 30. This enhances the design flexibility of the driving assistance device with the signal information processing device for a vehicle.

In the above-described embodiment, although the description is given of an example case in which the car navigation device 32 is provided with road map information, the present invention is not limited to this case, and the road map information may be separately provided from the car navigation. This enhances the design flexibility of the driving assistance device with the signal information processing device for a vehicle.

In the above-described embodiment, the description is given of an example case in which the driving assistance ECU 30 obtains the number of traffic lanes from the road map information. The present invention is, however, not limited to this case, and the driving assistance ECU 30 may obtain the number of traffic lanes from the infrastructure devices like the wireless beacon. In this case, when, for example, the vehicle 10 passes through the nearby location of the first traffic light 11, the driving assistance ECU 30 is configured to obtain the signal information corresponding to the first traffic light 11 from the wireless beacon. The driving assistance ECU 30 is also configured to obtain information on the driving environment corresponding to the second traffic light 12 from the wireless beacon. This enables the driving assistance ECU 30 to appropriately estimate the signal information on the second traffic light in addition to the obtainment of the signal information on the first traffic light. Accordingly, the design flexibility of the driving assistance device with the signal information processing device for a vehicle is enhanced.

In the above-described embodiment, the description is given of an example case in which the driving assistance ECU 30 obtains the signal information on the first traffic light 11, the signal lag F2 of the second traffic light 12, and the signal lag F2 of the third traffic light 13 through the same wireless beacon 15. The present invention is, however, not limited to this case, and the driving assistance ECU 30 may obtain at least one of the signal information on the first traffic light 11, the signal lag of the second traffic light, and the signal lag of the third traffic light through different infrastructure devices from each other like wireless beacons. This allows the driving assistance device with the signal information processing device for a vehicle to be applied to a wider range of types of roads.

In the above-described embodiment, the description is given of an example case in which the driving assistance ECU 30 obtains the signal lag F2 of the second traffic light 12 and the signal lag F2 of the third traffic light 13 from the wireless beacon 15 together with the signal information on the first traffic light 11. The present invention is, however, not limited to this case, and when the signal lag of the second traffic light and that of the third traffic light are set to be a fixed value in advance and do not change, such signal lag may be set in the driving assistance device beforehand. This expands the applicability of the driving assistance device.

In the above-described embodiment, the description is given of an example case in which the driving assistance ECU 30 obtains the number of traffic lanes of the cross-road at the second or third intersection 22 or 23 as a driving environment. The present invention is, however, not limited to this case, and the driving assistance ECU 30 may obtain, as the driving environment not limited to the number of traffic lanes, the amount of traffic, the average vehicle speed on the road, the road width, and the width of a traffic lane and may obtain a combination of those including the number of traffic lanes as the driving environment for the vehicle.

For example, the signal split time of an intersection often has an instruction time length for continuously permitting a traffic so as not to increase the number of vehicles waiting for a signal as much as possible in respective intersecting roads with each other, i.e., in accordance with a traffic amount. Hence, the driving assistance ECU 30 is capable of estimating the signal information on the second or third traffic light 12 or 13 provided at the intersection based on the traffic amount of each road intersecting at the intersection through, for example, a comparison of respective traffic amounts. This makes it possible for the driving assistance ECU 30 to appropriately perform a driving assist for the vehicle in relation to the estimated traffic light 12 or 13 at the second or third intersection.

At this time, the driving assistance ECU 30 may obtain the traffic amount, an average vehicle speed, a road width, and a width of a traffic lane from the wireless beacon, or may obtain those pieces of information from statistical information on a traffic amount possessed by the car navigation.

In the above-described embodiment, the description is given of an example case in which the driving assistance ECU 30 estimates the red starting time point Cr12 based on the signal cycle C1, the signal lag F2, and the driving environment at the second intersection 22, and also estimates the red starting time point Cr13 based on the signal cycle C1, the signal lag F3, and the driving environment at the third intersection 23. The present invention is, however, not limited to this case, and the driving assistance ECU 30 may calculate the red starting time point based on the signal cycle and the driving environment at the intersection when the signal lag cannot be obtained from the roadside device. Moreover, the driving assistance ECU 30 may calculate the red starting time point based on the already-calculated green starting time point, and the driving environment at the intersection. This enhances the design flexibility of the signal information processing device for a vehicle, and allows the device to be applied to a wider range of cases.

In the above-described embodiment, the description is given of an example case in which the driving assistance ECU 30 estimates the signal split time S2 of the second traffic light 12, and estimates the signal split time S3 of the third traffic light 13. The present invention is, however, not limited to this case, and when, for example, the collective control device 17 extends the signal cycle in accordance with the traffic amount at an intersection, the driving assistance ECU 30 may estimate the signal cycle based on, for example, the driving environment at the intersection. When estimating the time interval of the second traffic light for starting the green signal, i.e., the signal cycle, the driving assistance ECU 30 can obtain, for example, a lag of the cycle of the second traffic light relative to the first traffic light. This makes it possible for the driving assistance ECU 30 to appropriately perform a driving assistance to the vehicle in relation to the second traffic light. That is, the design flexibility of the signal information processing device for a vehicle and the applicability thereof are expanded. In this case, since the signal lag is made variable, the signal lag utilized at first for a calculation by the driving assistance ECU 30 may be a value at a predetermined reference time.

The driving assistance ECU 30 may estimate the signal split time as described above together with estimation of the signal cycle as described above. This expands the design flexibility of the signal information processing device for a vehicle and the applicability thereof.

Although the description is given of an example case in which the signal information processor 31 is provided in the vehicle 10 in the above-described embodiment, the present invention is not limited to this case, and the signal information processor may be provided at the exterior of the vehicle, for example, a management center capable of information processing. This enables the signal information processor to utilize a larger amount of information and a higher processing capacity to estimate unknown signal information.

DESCRIPTION OF THE REFERENCE NUMERALS

G Green signal
R Red signal
Y Yellow signal
C1 Signal cycle
F2, F3 Signal lag
S1, S2, S3 Signal split time
Cb1, Cb12, Cb22, Cb13, Cb23 Green starting time point
Cr1, Cr12, Cr13 Red starting time point
1A, 2A, 3A, 4A Vertical road
1S, 2S, 3S Horizontal road
10, 10A, 10B, 10C Vehicle
11 to 13 First to third traffic lights
14 Communication line
15 Wireless beacon
16 Communication line
17 Collective control device
20 Running road (road)
20A, 20B, 20C Cross-road (road)
21 to 23 First to third intersections
30 Driving assistance ECU
31 Signal information processor
32 Car navigation
33 Brake ECU
34 Engine ECU
35 Display screen
36 Speaker
37 Infrastructure communication device
38 GPS (Global Positioning System)
390 Vehicle speed sensor
391 Brake sensor
392 Accelerator sensor
70 to 73 Intersections
75 to 78 Intersections
80 to 83 Intersections

The invention claimed is:

1. A signal information processing device for a vehicle that processes signal information containing information on a state of a traffic light, the signal information processing device comprising:

a signal information estimating section circuitry which obtains signal information corresponding to a first traffic light, also obtains information on a relationship between a case in which a traffic of a vehicle is prompted and a case in which the traffic is inhibited as a driving environment for a vehicle corresponding to a second traffic light that is installed at a different location from the first traffic light, and estimates an instruction period at which the second traffic light instructs the vehicle to move forward or to stop as signal information on the second traffic light through a calculation based on the signal information corresponding to the first traffic light and the obtained information on the driving environment for the vehicle, wherein the second traffic light is installed at an intersection, and the signal information estimating section circuitry estimates the signal information on the second traffic light through a calculation based on the signal information corresponding to the first traffic light and information on a driving environment at the intersection, wherein the signal information estimating section circuitry is configured to obtain information of the driving environment corresponding the second traffic light as at least one of information on a number of traffic lanes of each of a plurality of roads intersecting with each other at the intersection and information on traffic amount of each of the plurality of roads intersecting with each other at the intersection, wherein the signal information estimating section circuitry is configured to estimate the instruction period based on the information corresponding to the traffic amount such that the instruction period of the second traffic light instructing the vehicle to move forward is longer than that of a traffic light, that is different from the second traffic light, instructing the vehicle to move forward on the intersecting road in a case of which the traffic amount of the road on which the second traffic light instructing the vehicle to move forward is larger than that of the intersecting road, wherein the signal information estimating section circuitry is configured to estimate the instruction period based on the information corresponding to the number of traffic lanes such that the instruction period of the second traffic light instructing the vehicle to move forward is longer than that of the traffic light, that is different from the second traffic light, instructing the vehicle to move forward on the intersecting road in a case of which the number of traffic lanes of the road on which the second traffic light instructing the vehicle to move forward is larger than that of the intersecting road.

2. The signal information processing device for a vehicle according to claim 1, wherein the signal information estimating section circuitry calculates, as a time difference, a lag of the signal information corresponding to the second traffic light relative to the signal information corresponding to the first traffic light.

3. The signal information processing device for a vehicle according to claim 2, wherein the signal information on the first traffic light further contains a starting time point at which the first traffic light starts permitting the vehicle to move forward, and the signal information estimating section circuitry further obtains information on a time difference between the forward movement permission starting time point by the first traffic light and a forward movement permission starting time point by the second traffic light, and further estimates, as the signal information on the second traffic light, an ending time point at which the forward movement permission by the second traffic light ends based on the estimated instruction period, the starting time point of the first traffic light, and the obtained information on the time difference.

4. The signal information processing device for a vehicle according to claim 1, wherein the signal information estimating section circuitry estimates the signal information on the second traffic light based on a presumption that a time interval at which the first traffic light repeatedly starts permitting a traffic to move forward is equal to a time interval at which the second traffic light repeatedly starts permitting a traffic to move forward.

5. The signal information processing device for a vehicle according to claim 1, wherein the signal information estimating section circuitry estimates, as the signal information on the second traffic light to be estimated, a time interval between a plurality of forward movement permission starts repeatedly provided to a traffic.

6. The signal information processing device for a vehicle according to claim 1, wherein the signal information estimating section circuitry obtains the signal information corresponding to the first traffic light and the information on the driving environment corresponding to the second traffic light from a roadside device that is provided at a roadside to correspond to the first traffic light.

7. The signal information processing device for a vehicle according to claim 1, wherein the signal information estimating section circuitry is built in the vehicle.

8. A driving assistance device comprising a signal information processing device for a vehicle that processes signal information containing information on a state of a traffic light, the driving assistance device being configured to perform a driving assist for a vehicle based on information processed through the signal information processing device, wherein the signal information processing device is the signal information processing device including: a signal information estimating section circuitry which obtains signal information corresponding to a first traffic light, also obtains information on a relationship between a case in which a traffic of a vehicle is prompted and a case in which the traffic is inhibited as a driving environment for a vehicle corresponding to a second traffic light that is installed at a different location from the first traffic light, and estimates an instruction period at which the second traffic light instructs the vehicle to move forward or to stop as signal information on the second traffic light through a calculation based on the signal information corresponding to the first traffic light and the obtained information on the driving environment for the vehicle, and wherein the driving assistance device performs the driving assist for the vehicle in relation to a second traffic light based on signal information on the second traffic light estimated by the signal information processing device, wherein the second traffic light is installed at an intersection, and the signal information estimating section circuitry estimates the signal information on the second traffic light through a calculation based on the signal information corresponding to the first traffic light and information on a driving environment at the intersection, wherein the signal information estimating section circuitry is configured to obtain information of the driving environment corresponding the second traffic light as at least one of information on a number of traffic lanes of each of a plurality of roads intersecting with each other at the intersection and information on traffic amount of each of the plurality of roads intersecting with each other at the intersection, wherein the signal information estimating section circuitry is configured to estimate the instruction period based on the information corresponding to the traffic amount such that the instruction period of the second traffic light instructing the vehicle to move forward is longer than that of a traffic light, that is different from the second traffic light, instructing the vehicle to move forward on the intersecting road in a case of which the traffic amount of the road on which the second traffic light instructing the vehicle to move forward is larger than that of the intersecting road, wherein the signal information estimating section circuitry is configured to estimate the instruction period based on the information corresponding to the number of traffic lanes such that the instruction period of the second traffic light instructing the vehicle to move forward is longer than that of the traffic light, that is different from the second traffic light, instructing the vehicle to move forward on the intersecting road in a case of which the number of traffic lanes of the road on which the second traffic light instructing the vehicle to move forward is larger than that of the intersecting road.

9. A signal information processing method for a vehicle performed by a signal information estimating section circuitry for processing signal information containing information on a state of a traffic light, the method comprising:

obtaining signal information corresponding to the first traffic light and obtaining information on a relationship between a case in which a traffic of a vehicle is prompted and a case in which the traffic is inhibited as a driving environment for a vehicle corresponding to a second traffic light that is installed at a different location from the first traffic light; and estimating an instruction period at which the second traffic light instructs the vehicle to move forward or to stop as signal information on the second traffic light through a calculation based on the signal information corresponding to the first traffic light and the obtained information on the driving environment of the vehicle, wherein the second traffic light is installed at an intersection, and the estimating of the signal information is executed by estimating signal information on the second traffic light through a calculation based on the signal information corresponding to the first traffic light and information on a driving environment at the intersection, wherein obtaining information of the driving environment corresponding the second traffic light as at least one of information on a number of traffic lanes of each of a plurality of roads intersecting with each other at the intersection and information on traffic amount of each of the plurality of roads intersecting with each other at the intersection, wherein estimating the instruction period based on the information corresponding to the traffic amount such that the instruction period of the second traffic light instructing the vehicle to move forward is longer than that of a traffic light, that is different from the second traffic light, instructing the vehicle to move forward on the intersecting road in a case of which the traffic amount of the road on which the second traffic light instructing the vehicle to move forward is larger than that of the intersecting road, wherein estimating the instruction period based on the information corresponding to the number of traffic lanes such that the instruction period of the second traffic light instructing the vehicle to move forward is longer than that of the traffic light, that is different from the second traffic light, instructing the vehicle to move forward on the intersecting road in a case of which the number of traffic lanes of the road on which the second traffic light instructing the vehicle to move forward is larger than that of the intersecting road.

10. The signal information processing method for a vehicle according to claim 9, wherein estimating the signal information is to calculate, as a time difference, a lag of the signal information corresponding to the second traffic light relative to the signal information corresponding to the first traffic light.

11. A driving assistance method utilizing a signal information processing method for a vehicle performed by a driving assistance device including a signal information processing device for processing signal information containing information on a state of a traffic light, the driving assistance method comprising performing a driving assist for a vehicle in relation to the traffic light based on a state of the traffic light, wherein the signal information processing method performed by a signal information estimating section circuitry of the signal information processing device is the signal information processing method including obtaining signal information corresponding to the first traffic light and obtaining information on a relationship between a case in which a traffic of a vehicle is prompted and a case in which the traffic is inhibited as a driving environment for a vehicle corresponding to a second traffic light that is installed at a different location from the first traffic light; and estimating an instruction period at which the second traffic light instructs the vehicle to move forward or to stop as signal information on the second traffic light through a calculation based on the signal information corresponding to the first traffic light and the obtained information on the driving environment of the vehicle, in which a driving assist for the vehicle in relation to the second traffic light is performed based on signal information on the second traffic light estimated through the signal information processing method, wherein the second traffic light is installed at an intersection, and the estimating of the signal information is executed by estimating signal information on the second traffic light through a calculation based on the signal information corresponding to the first traffic light and information on a driving environment at the intersection, wherein obtaining information of the driving environment corresponding the second traffic light as at least one of information on a number of traffic lanes of each of a plurality of roads intersecting with each other at the intersection and information on traffic amount of each of the plurality of roads intersecting with each other at the intersection, wherein estimating the instruction period based on the information corresponding to the traffic amount such that the instruction period of the second traffic light instructing the vehicle to move forward is longer than that of a traffic light, that is different from the second traffic light, instructing the vehicle to move forward on the intersecting road in a case of which the traffic amount of the road on which the second traffic light instructing the vehicle to move forward is larger than that of the intersecting road, wherein estimating the instruction period based on the information corresponding to the number of traffic lanes such that the instruction period of the second traffic light instructing the vehicle to move forward is longer than that of the traffic light, that is different from the second traffic light, instructing the vehicle to move forward on the intersecting road in a case of which the number of traffic lanes of the road on which the second traffic light instructing the vehicle to move forward is larger than that of the intersecting road.

* * * * *